United States Patent [19]

Copperi

[11] Patent Number: 4,860,355

[45] Date of Patent: Aug. 22, 1989

[54] METHOD OF AND DEVICE FOR SPEECH SIGNAL CODING AND DECODING BY PARAMETER EXTRACTION AND VECTOR QUANTIZATION TECHNIQUES

[75] Inventor: Maurizio Copperi, Venaria, Italy

[73] Assignee: Cselt Centro Studi e Laboratori Telecomunicazioni S.P.A., Turin, Italy

[21] Appl. No.: 109,500

[22] Filed: Oct. 15, 1987

[30] Foreign Application Priority Data

Oct. 21, 1986 [IT] Italy ..... 67792 A/86

[51] Int. Cl.[4] ..... G10L 5/00

[52] U.S. Cl. ..... 381/36

[58] Field of Search ..... 381/36–53

[56] References Cited

PUBLICATIONS

An Algorithm for Vector Qunatizer Design by Y. Linde et al., published IEEE Transactions, vol. COM 28, No. 1, Jan. 1980.

A New Model of LPC Excitation . . . by Bishnu S. Atal et al., IEEE 1982, CH-1746-7/82/0000-1614.

Code Excited Linear Prediction CELP . . . by M. R. Schroeder et al., IEEE 1985, CH-2118-8/85/00-00-0937.

Distortion Performance of Vector Quantization for LPC Voice Coding by Biing-Hwang Juang et al., IEEE Transactions, vol. ASSP-30, No. 2, Apr. 1982.

*Primary Examiner*—Emanuel S. Kemeny

*Attorney, Agent, or Firm*—Herbert Dubno

[57] ABSTRACT

This method provides a filtering of blocks of digital samples of speech signal by a linear-prediction inverse filter followed by a shaping filter, whose coefficients are chosen out of a codebook of quantized filter coefficient vectors, obtaining a residual signal subdivided into vectors. Each vector is classified by an index q depending on the zero-crossing frequency and r.m.s. value; it is then normalized on the basis of the quantized r.m.s. value, and then of a vector of quantized short-term mean values; the mean-square error made in quantizing said vectors with vectors contained in a codebook and forming excitation waveforms in computed. In this codebook the search is limited to a subset of vectors determined by index q and p of short-term mean vector. The coding signal consists of the index of the filter coefficient vector, of indices q, p, of quantization index m of the r.m.s. value, and of the index of the vector of the excitation waveform which has generated minimum weighted mean-square error (FIG. 1).

6 Claims, 2 Drawing Sheets

METHOD OF AND DEVICE FOR SPEECH SIGNAL CODING AND DECODING BY PARAMETER EXTRACTION AND VECTOR QUANTIZATION TECHNIQUES

DESCRIPTION

The present invention concerns low-bit rate speech signal coders and more particularly it relates to a method of and a device for speech signal coding and decoding by parameter extraction and vector quantization techniques.

Conventional devices for speech signal coding, usually known in the art as "Vocoders", use a speech synthesis method in which a synthesis filter is excited, whose transfer function simulates the frequency behaviour of the vocal tract with pulse trains at pitch frequency for voiced sounds or with white noise for unvoiced sounds.

This excitation technique is not very accurate. In fact, the choice between pitch pulses and white noise is too stringent and introduces a high degradation of reproduced-sound quality.

Besides, both voice-unvoiced sound decision and pitch value are difficult to determine with sufficient accuracy.

A method for exciting the synthesis filter, intended to overcome the disadvantages above, is described in the paper by B. S. Atal, J. R. Remde "A new model of LPC excitation for producing natural-sounding speech at low bit rates", International Conference on ASSP, pp. 614–617, Paris 1982.

This method uses a multi-pulse excitation, i.e. an excitation consisting of a train of pulses whose amplitudes and positions in time are determined so as to minimize a perceptually-meaningful distortion measure. Said distortion measure is obtained by a comparison between the synthesis filter output samples and the original speech samples, and by a weighting by a function which takes account of how human auditory perception evaluates the introduced distortion. Yet, said method cannot offer good reproduction quality at a bit rate lower than 10 kbit/s. In addition excitation-pulse computing algorithms require a too high amount of computations.

Another known method for exciting the synthesis filter, using vector-quantization techniques, is described e.g. in the paper by M. R. Schroeder, B. S. Atal "Code-excited linear prediction (CELP): high-quality speech at very low bit-rates", Proceedings of International Conference on ASSP, pagg. 937–940, Tampa-Florida, Marzo 1985. According to this technique the speech synthesis filter is excited by trains of suitable quantized waveform vectors forming excitation vectors chosen out of a codebook generated once for all in an initial training phase or built up with sequences of Gaussian white noise.

In the cited paper, each sequence of a given number of samples of the original speech signal is compared with all the vectors contained in the codebook and filtered through two cascaded linear recursive digital filters with time-varying coefficients, the first filter having a long-delay predictor to generate the pitch periodicity, the second a short delay predictor to generate spectral envelope resonances.

The difference signals obtained in the comparison are then filtered through a weighting linear filter to attenuate the frequencies wherein the introduced error is perceptually less significant and to enhance on the contrary the frequencies where the error is perceptually more significant, thus obtaining a weighted error: the codebook vector generating the minimum weighted error is considered as representative of the speech signal segment.

Said method has been specifically developped for applications in low bit-rate speech signal transmission, since it allows a considerable reduction in the number of coding bits to transmit while obtaining an adequate reproduction quality of the speech signal.

The main disadvantage of this method is that it requires too large an amount of computations, as reported by the authors themselves in the paper conclusions. The large computing amount is due to the fact that for each segment of original speech signal, all the codebook vectors are to be considered and a considerable number of operations is to be effected for each of them.

For these resons the method, as suggested in the cited paper, cannot be used for real-time applications by the available technology.

These problems are overcome by the present invention of a speech-signal coding method using extraction of characteristic parameters of the speech signal, vector-quantization techniques and perceptual subjective distortion measures, which method carries out a given preliminary filtering on the segments of the speech signal to be coded, such that on each segment of filtered signal it is possible to carry out a number of operations allowing a sufficiently small subset of the codebook of vectors of quantized waveforms to be found in which to look for the vector minimizing the error code.

Thus the total number of operations to be carried out can be considerably reduced since the number of the codebook vectors to be analyzed for each segment of the original speech signal is dramatically reduced, allowing in this way real-time specifications to be met without degrading in a perceptually significant way the reproduced speech signal quality.

It is the main object of the present invention to provide a method for speech-signal coding-decoding, as described in claims 1 and 2.

It is a further object of the present invention to provide a device for speech-signal coding-decoding, as described in claims 3 to 6.

The invention is now described with reference to the annexed drawings in which.

The method, according to the invention, comprising the coding phase of the speech signal and the decoding phase or speech synthesis, will be now described.

Figure 1:
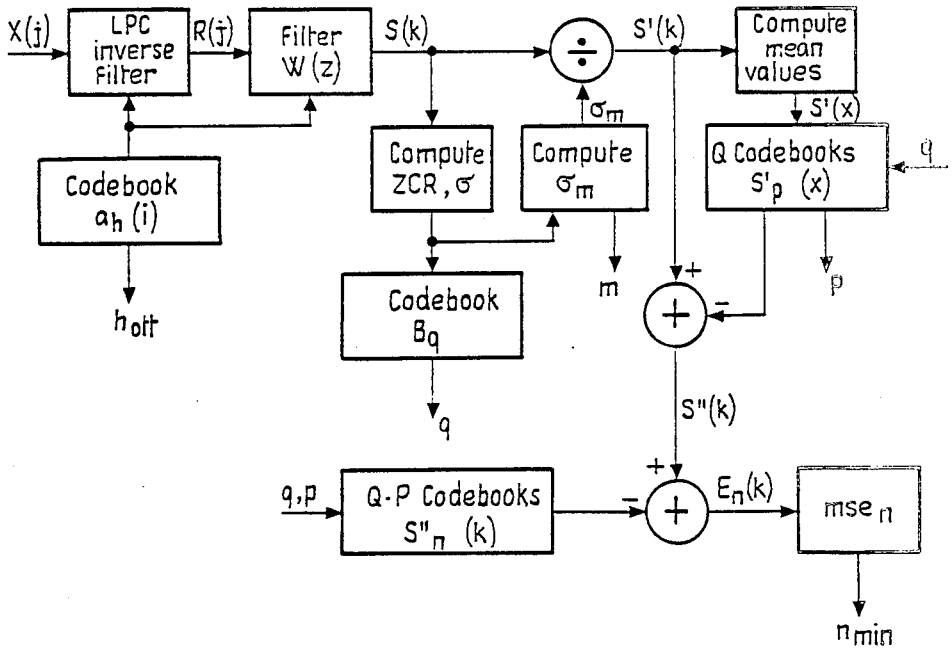
FIG. 1 shows a block diagram relating to the method of coding the speech signal according to the invention.

With reference to FIG. 1, in the coding phase the speech signal is converted into blocks of digital samples x(j), with j=index of the sample in the block ($1 \leqq j \leqq J$).

The blocks of digital samples x(j) are then filtered according to the known technique of linear-prediction inverse filtering, or LPC inverse filtering, whose transfer function H(z), in the Z transform, is in a non-limiting example:

$$H(z) = \sum_{i=0}^{L} a(i) \cdot z^{-i} = 1 - \sum_{i=1}^{L} a(i) \cdot z^{-i} \qquad (1)$$

where $z^{-1}$ represents a delay of one sampling interval; a(i) is a vector of linear-prediction coefficients ($0 \leqq i \leqq L$); L is the filter order and also the size of vector a(i), a(0) being equal to 1.

Coefficient vector a(i) must be determined for each block of digital samples x(j). Said vector is chosen, as will be described hereinafter, in a codebook of vectors of quantized linear-prediction coefficients $a_h(i)$, where h is the vector index in the codebook ($1 \leqq h \leqq H$).

The vector chosen allows, for each block of samples x(j), the optimal inverse filter to be built up; the chosen vector index will be hereinafter denoted by $h_{ott}$.

As a filtering effect, for each block of samples x(j), a residual signal R(j) is obtained, which is then filtered by a shaping filter having transfer function W(z) defined by the following relation:

$$W(z) = \frac{1}{1 - \sum_{i=1}^{L} a_h(i) \cdot \gamma^i \cdot z^{-i}} \quad (2)$$

where $A_h(i)$ is the coefficient vector selected in the codebook for the already-mentioned inverse filter LPC while $\gamma$ ($0 \leqq \gamma \leqq 1$) is an experimentally determined corrective factor which determines a bandwidth increase around the formats; indices h used are still indices $h_{ott}$.

The shaping filter is intended to shape, in the frequency domain, residual signal R(j), having characteristics similar to random noise, to obtain a signal, hereinafter referred to as filtered residual signal S(j), with characteristics more similar to real speech.

The filtered residual signal S(j) presents characteristics allowing application threon of simple classifying algorithms facilitating the detection of the optimal vector in the quantized-vector codebook defined in the following.

The filtered residual signal S(j) is subdived into a group of filtered residual vectors S(k), with $1 \leqq k \leqq K$, where K is an integer submultiple of J. The following operations are carried out on the residual filtered vectors S(k).

As a first step, zero-crossing frequency ZCR and r.m.s. value $\sigma$, given by the following relations are computed for each filtered residual vector S(k):

$$ZCR = \sum_{k=1}^{K-1} \frac{1 - \text{sign}\,[S(k)] \cdot \text{sign}\,[S(k+1)]}{2} \quad (3)$$

$$\sigma = \beta \cdot \sum_{k=1}^{K} |S(k)| \quad (4)$$

where in (3) "sign" denotes the sign bit of the relevant sample (values "+1" for positive samples and "−1" for negative samples), and in (4)$\beta$ denotes a constant experimentally determined so as to obtain maximum correlation between actual and estimated r.m.s. value.

During an initial training phase, a determined subdivision of plane (ZCR), $\sigma$) in to a number Q of areas Bq ($1 \leqq q \leqq Q$) is established once for all. ZCR and being positive, only the first plane quadrant is considered. Positive plane semiaxes are then subdivided into suitable intervals identifying the different areas.

During the coding phase area Bq, wherein the calculated pair of values ZCR, $\beta$ falls, is detected by carrying out a series of comparisons of the pairs of values ZCR, $\sigma$ with the end points of the various intervals. Index q of the area forms a first classification of vector S(k).

R.m.s. value $\sigma$ is then quantized by using a codebook of M quantized r.m.s. values $\sigma_m$, with $1 \leqq m \leqq M$, preserving index $\sigma$ found out.

As a second step, vector S(k) is normalized with unitary energy by dividing each component by the quantized r.m.s. value $\sigma_m$, thus obtaining a first normalized filtered residual vector S'(k). Vector S'(k) is then subdivided into subgroups S'(y), with $1 \leqq y \leqq Y$, where Y is an integer submultiple of K.

The mean value of each vector S'(y) is then computed, thus obtaining a new vector of means values S'(x), with $1 \leqq x \leqq X$, having $X = K/Y$ components, which gives an idea of the envelope of vector S''(k), i.e. which contains the information on the large variations of the waveform.

The vector of means values S'(x) is then quantized by choosing the closest one among the vectors of quantized mean values Sp'(x) belonging to a codebook of size P, with $1 \leqq p \leqq P$.

Q codebooks are present, one for each area into which the plane (ZCR, $\sigma$) is subdivided; the codebook used will be the one corresponding to the area wherein the original vector S(k) falls, said codebook being identified by index q previously found.

Said Q codebooks are determined once for all, as will be explained hereinafter, by using vectors S''(x) extracted from the training speech signal sequence and belonging to the same area in plane (ZCR, $\sigma$).

Therefore, mean vector S'(x) is quantized by the codebook corresponding to the q-th area, thereby obtaining a quantized mean vector Sp'(x); vector index $\sigma$ forms a second classification of vector S(k).

Quantized mean vector Sp'(x) is then substracted from normalized filtered residual vector S'(k) so as to normalize vector S(k) also in short-term mean value, thus obtaining a second normalized filtered residual vector S''(k).

Vector S''(k) is then quantized by comparing it with vectors $S_n''(k)$ of a codebook of second quantized normalized filtered residual vectors of size N, with $1 \leqq n \leqq N$. Q.P codebooks are present; the pair of indices previously found identifies the codebook of vectors $S_n''(k)$ to be used.

Each of said codebooks has been built during an initial training phase, which will be disclosed hereinafter, by using vectors S''(k) obtained from training speech signal sequence and having the same indices q, p. For each comparison of vector S''(k) with a vector $S_n''(k)$ of the chosen codebook, an error vector $E_n(k)$ is created. Mean square value $mse_n$ of that vector is then computed according to the following relationship:

$$mse_n = \frac{1}{K} \sum_{k=1}^{K} E_n^2(k) \quad (5)$$

For each vector S''(k), the vector originating minimum value of $mse_n$ is chosen in the codebook. Index $n_{min}$ of said vector forms a third classification of vector S(k).

For each original block of samples x(j), speech signal coding signal is formed by:

index $h_{ott}$, varying every J samples;

indices p, q, $n_{min}$, varying every K samples;

index m, this too varying every K samples.

In a particular non-limiting example of application of the method, the following values have been used; sampling frequency $f_c = 8$ KHz for generating samples x(j);

J=160; H=1024; K=40; Q=8; M=64; Y=4; X=10; P=16; N=8.

The entity of reduction in the research in the codebook of vectors $S_n''(k)$ is evident; in fact, for a total amount of Q·P·N=1024 vectors, the research is limited to the 8 vectors of one of 128 codebooks.

Figure 2:
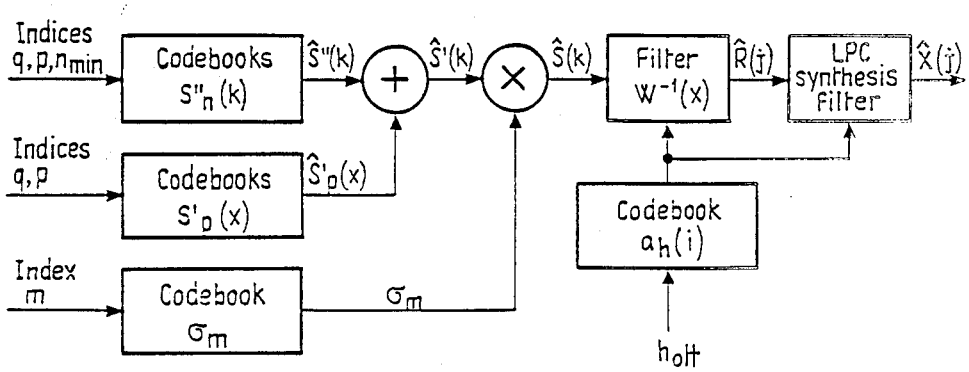
FIG. 2 shows a block diagram concerning the decoding method.

With reference to FIG. 2, during decoding, indices q, p, $n_{min}$, found out during the coding step identify, in one of the Q≦P codebooks of vectors of second quantized normalized filtered residual, vector $S_n''(k)$ which is summed to vector Sp'(x). The latter is identified by the same indices q, p in one of the P codebooks of quantized means vectors values Sp'(x). Thus a first normalized filtered residual vector S'(k) is obtained again. In the codekook of quantized r.m.s. values $\sigma_m$, index m, found during the coding step, detects value $\sigma_m$ by which the just found vector S'(k) is to be multiplied; thus a filtered residual vector S(k) is obtained again.

Vector S(k) is filtered by filter $W^{-1}(z)$ which is the inverse filter with respect to the shaping filter used during the coding phase, thus recovering a residual vector R(j) forming the excitation for an LPC synthesis filter whose transfer function is the inverse of H(z) defined in (1).

Quantized digital samples X(j) are thus obtained which, reconverted into analog form, give the speech signal reconstructed in decoding or synthesis.

Coefficients for filters $W^{-1}(z)$ and for LPC synthesis filter are those identified in codebook of coefficients $a_h(i)$ by index $h_{ott}$ computed during coding.

The technique used for the generation of the codebook of vectors of quantized linear-prediction coefficients $a_h(i)$ is the known vector quantization by measure and minimization of the spectral distance $d_{LR}$ between normalized-gain linear prediction filters (likelihood ratio measure), described for instance in the paper by B. H. Juang, D. Y. Wong, A. H. Gray "Distortion performance of Vector Quantization for LPC Voice Coding", IEEE Transactions on ASSP, vol. 30, n. 2., pp. 294–303, April 1982. The same technique is also used for the choice of coefficient vector $a_h(i)$ in the codebook, during coding phase in transmission.

This coefficient vector $a_h(i)$, which allows the building of the optimal LPC inverse filter, is that which allows minimization of spectral distance $d_{LR}(h)$ given by relation:

$$d_{LR}(h) = \frac{\sum_{i=-L}^{L} C_a(i,h) \cdot C_x(i)}{\sum_{i=-L}^{L} C^*_a(i) \cdot C_x(i)} - 1 \qquad (6)$$

where $C_x(i)$, $C_a(i,h)$, $c^*_a(i)$ are vectors of autocorrelation coefficients—respectively of blocks of digital samples x(j), of coefficients $a_h(i)$ of generic LPC filter of the codebook, and of filter coefficients calculated by using current samples x(j).

Minimizing distance $d_{LR}(h)$ is equivalent to finding the minimum of the numerator of the fraction in (6), since the denominator only depends on input samples x(j). Vectors $C_x(i)$ are computed starting from input samples x(j) of each block, said samples being previously weighted according to the known Hamming curve with a length of F samples and a superposition between consecutive windows such as to consider F consecutive samples centered around the J samples of each block.

Vector $C_x(i)$ is given by the relation:

$$C_x(i) = \sum_{j=1}^{F-M} x(j) \cdot x(j+l) \qquad (7)$$

Vectors $C_a(i,h)$ are on the contrary extracted from a corresponding codebook in one-to-one correspondance with that of vectors $a_h(i)$.

Vectors $C_a(i,h)$ are derived from the following relation:

$$\sum_{q=0}^{L-1} a_h(q) \cdot a_h(q+l) \qquad (8)$$

$$C_a(i,h) = 0 \text{ for } i > L$$

For each value h, the numerator of the fraction in relation (6) is calculated using relations (7) and (8); the index $h_{ott}$ supplying minimum value $d_{LR}(h)$ is used to choose vector $a_h(i)$ out of the relevant codebook.

The generation of Q codekooks containing each P vectors of quantized mean values Sp'(x) and of Q·P codekooks containing each N second quantized normalized filtered residual vectors Sn''(k) is preliminarly carried out, on the basis of a segment of convenient length of a training speech signal; a known technique is used based on the computation of centroids with iterative methods using generalized Lloyd algorithm, e.g. as described in the paper by Y. Linde, A. Buzo e R. Gray: "An algorithm for vector quantizer design:, IEEE Trans. on Comm., Vol. 28, pp. 84–95, January 1980.

Figure 3:
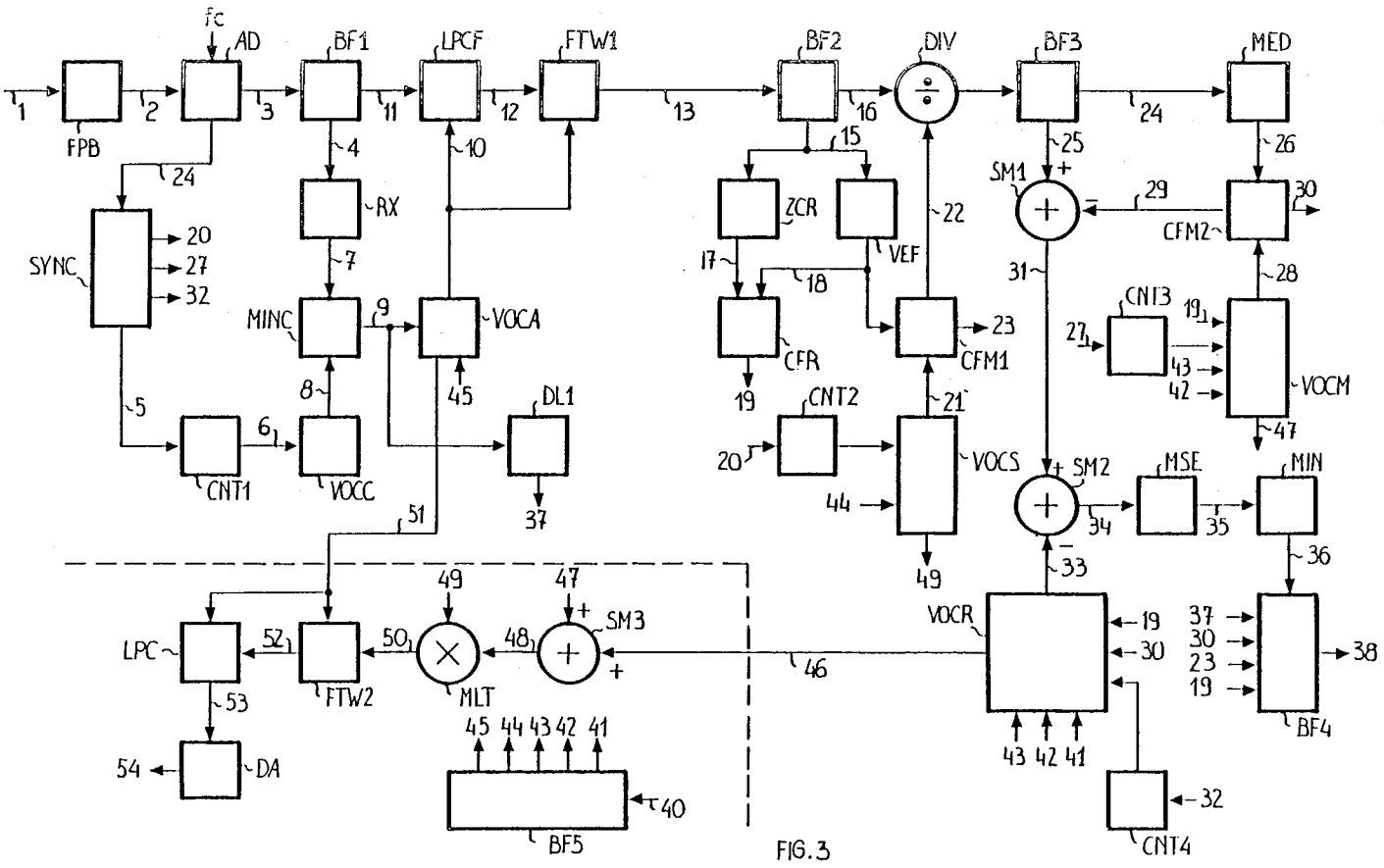
FIG. 3 shows a block diagram of the device for implementing such a method.

Referring now to FIG. 3, we will first describe the structure of the speech signal coding section, whose circuit blocks are shown above the dashed line separating coding and decoding sections.

FPB denotes a low-pass filter with cutoff frequency at 3.4 kHz for the analog speech signal it receives over wire 1.

AD denotes an analog-to-digital converter for the filtered signal received from FPB over wire 2. AD utilizes a sampling frequency fc=8 kHz, and obtains speech signal digital samples x(j) which are also subdivided into successive blocks of J=160 samples; this corresponds to subdividing the speech signal into time intervals of 20 ms.

BF1 denotes a block containing two conventional registers with capacity of F=200 samples received on connection 3 from converter AD. In correspondence with each time interval identified by AD, BF1 temporarily stores the last 20 samples of the preceding interval, the samples of the present interval and the first 20 samples of the subsequent interval; this greater capacity of BF1 is necessary for the subsequent weighting of blocks of samples x(j) according to the abovementioned technique of superposition between subsequent blocks.

At each interval one register of BF1 is written by AD to store the samples x(j) generated, and the other register, containing the samples of the preceding interval, is read by block RX; at the subsequent interval the two registers are interchanged. In addition the register being written supplies on connection 11 the previously stored samples which are to be replaced. It is worth noting that only the J central samples of each sequence of F samples of the register of BF1 will be present on connection 11.

RX denotes a block weighting samples x(j), which it receives from BF1 through connection 4, according to the superposition technique, and calculating autocorrelation coefficients $C_x(j)$, defined in (7), it supplies on connection 7.

VOCC denotes a read-only-memory containing the codebook of vectors of autocorrelation coefficients $C_a(i,h)$ defined in (8), it supplies on connection 8, according to the addressing received from block CNT1.

CNT1 denotes a counter synchronized by a suitable timing signal it receives on wire 5 from block SYNC. CNT1 emits on connection 6 the addresses for the sequential reading of coefficients $C_a(i,h)$ from VOCC.

MINC denotes a block which, for each coefficient $C_a(i,h)$ it receives on connection 8, calculates the numerator of the fraction in (6), using also coefficient $C_x(i)$ present on connection 7. MINC compares with one another the H distance values obtained for each block of samples x(j) and supplies on connection 9 index $h_{ott}$ corresponding to the minimum of said values.

VOCA denotes a read-only-memory containing the codebook of linear-prediction coefficients $a_h(i)$ in one-to-one correspondence with coefficients $C_a(i,h)$ present in VOCC. VOCA receives from MINC through connection 9 indices $h_{ott}$ defined hereinbefore, which form the reading addresses of coefficients $a_h(i)$ corresponding to values $C_a(i,h)$ which have generated the minima calculated by MINC.

A vector of linear-prediction coefficients $a_h(i)$ is then read from VOCA at each 20 ms time interval, and is supplied on connection 10 to blocks LPCF and FTW1.

Block LPCF carries out the known function of LPC inverse filter according to function (1). Depending on the values of speech signal samples x(j) it receives from BF1 on connection 11, as well as on the vectors of coefficients $a_h(i)$ it receives from VOCA on connection 10, LPCF obtains at each interval a residual signal R(j) consisting of a block of 160 samples supplied on connection 12 to block FTW1. This is a known block filtering vectors R(j) according to weighting function W(z) defined in (2). Moreover FTW1 previously calculates coefficient vector $\gamma^i \cdot a_h(i)$ starting from vector $a_h(i)$ it receives on connection 10 from VOCA. Each vector $\gamma^i \cdot a_h(i)$ is used for the corresponding block of residual signal R(j).

FTW1 supplies on connection 13 the blocks of filtered residual signal S(j) to register BF2 which temporarily stores them.

In BF2 each block S(J) is subdivided into four consecutive filtered residual vectors S(k); the vectors have each a length K=40 samples and are emitted one at a time on connection 15 and then, conveniently delayed, on connection 16. The 40 samples correspond to a 5 ms duration.

ZCR denotes a known block calculating zero-crossing frequency for each vector S(k), it receives on connection 15. For each vector compoent, ZCR considers the sign bit, multiplies the sign bits of two contiguous components, and effects the summation according to relation (3), supplying the result on connection 17.

VEF denotes a known block calculating r.m.s. value of each vector S(k) according to relation (4) and supplying the result on connection 18.

CFR denotes a block carrying out a series of comparisons of the pair of values present on connections 17 and 18 with the end points of the intervals into which the positive semiaxes of plane (ZCR, $\sigma$) are subdivided. The pair of intervals whithin which the pair of input values falls is denoted by an index q supplied on connection 19.

The values of the end points of the intervals and indices q corresponding to the pairs of intervals are stored in memories inside CFR. The construction of block CFR is no problem to the skilled in the art.

The r.m.s. value on connection 18 is also supplied to block CMF1.

VOCS denotes a ROM containing the codebook of quantized r.m.s. values $\sigma_m$ sequentially read according to the addresses supplied by counter CNT2 started by signal 20 supplied by block SYNC. the values read are supplied to block CFM1 on connection 21.

CFM1 comprises a circuit computing the difference between the value present o connection 18 and all the values supplied by VOCS on connection 21; it also comprises a comparison and storage circuit supplying on connection 22 the quantized r.m.s. value $\sigma_m$ originating the minimum difference, and on connection 23 the corresponding index m.

Once the just-described computations have been carried out, register BF2 supplies again on connection 16 the components of vector S(k) which are divided in divider DIV by value $\sigma_m$ present on connection 22, obtaining the components of vector S'(k) which are supplied on connection 24 to register BF3 storing them temporarily.

In BF3 each vector S'(k) is subdivided into 10 consecutive vectors S'(y) of 4 components each (Y=4). BF3 supplies vectors S'(y) to block MED through connection 24.

MED calculates the mean value of the 4 components of each vector S'(y) thus obtaining a vector of mean values S'(x) having 10 components (X=K/Y=10), it temporarily stores in an interval memory.

For each vector S'(k) present in BF3, MED obtains threfore a vector S'(x) it supplies to an input of block CFM2 on connection 26.

VOCM denotes a read only memory containing the Q codebooks of vectors of quantized mean values Sp'(x). The address input of VOCM receives index q, supplied by block CFR on connection 19 and addressing the codebook, and the output of counter CNT3, started by signal 27 it receives from block SYNC, which sequentially addresses codebook vectors. These are sent through connection 28 to a second input of block CFM2.

CFM2, whose structure is similar to that of CFM1, determines for each vector S'(k), a vector of quantized mean values Sp'(x), it supplies on connection 29, and relevant index it supplies on connection 30.

Once the operations carried out by blocks MED and CFM2 are at an end, register BF3 supplies again on connection 25 vector S'(k) wherefrom there is subtracted in subtractor SM1 vector Sp'(x) present on connection 29, thus obtaining on connection 31 a normalized filtered second residual vector S''(k).

VOCR denotes a read only memory containing the Q·P codebooks of vectors Sn''(k).

VOCR receives at the address input indices q, p, present on connections 19 and 30, addressing the codebook to be used, and the output of counter CNT4, started by signal 32 supplied by block SYNC, to sequentially address the codebook vectors supplied on connection 33.

Vectors S''p(k) are subtracted in subtractor SM2 from vector S''(k) present on connection 31, obtaining on connection 34 vector $E_n(k)$.

MSE dentoes a block calculating means square error $mse_n$, defined in (5), relative to each vector $E_n(k)$, and supplying it on connection 20 with the corresponding value of index n.

In block MIN the minimum of values $mse_n$, supplied by MSE, is identified for each of the original vectors S(k); the corresponding index $n_{min}$ is supplied on connection 36.

BF4 denotes a register which stores, for each vector S(j), an index $h_{ott}$ present on connection 37, and sets of four indices q, m, p, $n_{min}$, one set for each vector S(k). Said indices form in BF4 a word coding the relevant 20ms interval of speech signal, which word is the encoder output word supplied on connection 38.

Index $h_{ott}$ which was present on connection 9 in the preceding interval, is present on connection 37, delayed by an interval of J samples by delay circuit DL1.

The structure of decoding section, composed of circuit blocks BF5, SM3, MLT, FTW2, LPC, DA drawn below the dashed line, will be now described.

BF5 denotes a register which temporarily stores speech signal coding words, it receives on connection 40. At each interval of J samples, BF5 supplies index $h_{ott}$ on connection 45, and the sequence of sets of four indices $n_{min}$, which vary at intervals of K samples, respectively on connections 41, 42, 43, 44. The indices on the outputs of BF5 are sent as addresses to memories VOCA, VOCS, VOCM, VOCR, containing the various codebooks used also in the coding phase, to directly select the quantized vectors regenerating the speech signal.

More particularly VOCR receives indices q, p, $n_{min}$, and supplies on connection 46 a vector of quantized normalized filtered second residual vector Sn''(k), while VOCM receives indices and supplies on connection 47 a quantized mean vector Sp'(x).

The vectors present on connections 46, 47 are added up in adder SM3 which supplies on connection 48 a first quantized normalized filtered residual vector S'(k) which is multiplied in multiplier MLT by quantized r.m.s. value $\sigma_m$ supplied on connection 49 by memory VOCS, addressed by index m received on connection 44, thus obtaining on connection 50 a quantized filtered residual vector S(k).

FTW2 is a linear-prediction digital filter having an inverse transfer function to that of shaping filter FTW1 used for decoding. FTW2 filters the vectors present on connection 50 and supplies on connection 52 quantized residual vectors R(j). The latter form the excitation for a synthesis filter LPC, this too of the linear-prediction type, with transfer function $H^{-1}(z)$. The coefficients for filters FTW2 and LPC filters are linear-prediction coefficient vectors $a_{hott}(i)$ supplied on connection 51 by memory VOCA addressed by indices $h_{ott}$ it receives on connection 45 from BF5.

On connection 53 there are present quantized digital samples (j) which, reconverted into analog form by digital-to-analog converter DA, form the speech signal reconstructed during decoding. This signal is present on connection 54.

SYNC denotes a block supplying the circuits of the device shown in FIG. 3 with synchronism signals. For simplicity sake the Figure shows only the synchronism signals of counters CNT1, CNT2, CNT3, CNT4. Register BF5 of the decoding section will require also an external synchronization, which can be derived from the line signal, present on connection 40, with usual techniques which do not require further explanations. Block SYNC is synchronized by a signal at a sample-block frequency arriving from AD on wire 24.

Modifications and variations can be made in the just described exemplary embodiment without going out of the scope of the invention.

For example the vectors of coefficients $\lambda^i \cdot a_h(i)$ for filters FTW1 and FTW2 can be extracted from a further read-only-memory whose contents is in one-to-one correspondence with that of memory VOCA of coefficient vectors $a_h(i)$. The addresses for the further memory are indices $h_{ott}$ present on output connection 9 of block MINC or on connection 45. By this circuit variant the calculation of coefficients $\gamma^i \cdot a_h(i)$ can be avoided at the cost of an increase in the overall memory capacity needed by the circuit.

I claim:

1. Method of speech signal coding and decoding, said speech signal being subdivided into time intervals and converted into blocks of digital samples x(j), characterized in that for speech signal coding each block of samples x(j) undergoes a linear-prediction inverse filtering operation by choosing in a codebook of quantized filter coefficient vectors $a_h(i)$, the vector of index $h_{ott}$ forming the optimum filter, and then undergoes a filtering operation according to a frequency weighting function W(z), whose coefficients are said vector $a_h(i)$ of the optimum filter multiplied by a factor $\lambda^i$, with $\lambda$ constant, thus obtaining a filtered residual signal S(j) which is then subdivided into filtered residual vectors S(k) for each of which the following operations are carried out:

a zero-crossing frequency ZCR and a r.m.s. value of said vector S(k) are computed;

depending on values ZCR, $\sigma$, vector S(k) is classified by an index q ($i \leqq q \leqq Q$) which identifies one out of Q areas of plane (ZCR, $\sigma$);

r.m.s. value $\sigma$ is quantized on the basis of a codebook of quantized r.m.s. value $\sigma_m$ and vector S(k) is divided by quantized r.m.s. value $\sigma_m$ with index m, thus obtaining a first normalized filtered residual vector S'(k) which is then subdivided into Y subgroups of vectors S'(y), ($1 \leqq y \leqq Y$);

a mean value of the components of each subgroup of vectors S'(y) is then computed, thus obtaining a vector of mean values S'(x), with $X = K/Y$ components, which is quantized by choosing a vector of quantized mean values Sp'(x) of index p ($1 \leqq p \leqq P$) in one of Q codebooks identified by said index q, thus obtaining a quantized means value Sp'(x);

the quantized means vector Sp'(x) is subtracted from said first vector S'(k), thus obtaining a second normalized filtered residual vector S''(k) which is compared with each vector in one out of Q·P codebooks of size N identified by said indices thus obtaining N quantization error vectors $E_n(k)$, ($1 \leqq n \leqq N$), for each of the latter a mean square error $mse_n$ being computed, index $n_{min}$ of the vector of the codebook which has generated the minimum value of $mse_n$, together with indices relevant to each filtered residual vector S(k) and with said index $h_{ott}$, forming the coded speech signal for a block of samples x(j).

2. A method according to claim 1, characterized in that, for speechsignal decoding, at each interval of K samples, said indices $n_{min}$ identify in the respective codebook a second quantized normalized filtered residual vector S''(k), while said indices identify in the respective codebook a quantized mean vector Sp'(k), which is then added to said second residual vector S''(k) thus obtaining a first quantized normalized filtered residual vector S'(k) which is then multiplied by a quantized r.m.s. value $\sigma_m$ identified in the relevant codebook by said index m, thus obtaining a quantized filtered residual vector S(k); the latter being then filtered by linear prediction techniques by inverse filters of those used during coding and having as coefficients vectors $a_h(i)$ of index $h_{ott}$ of the optimum filter, whereby digital quantized samples (j) of reconstructed speech signal are obtained.

3. Device for speech signal coding and decoding, said device comprising at the coding side input a low-pass filter (FPB) and an analog-to-digital converter (AD) to obtain said blocks of digital samples x(j), and at the decoding side output a digital-to-analog converter (DA) to obtain the reconstructed speech signal, characterized in that for speech signal coding it basically comprises:

a first register (BF1) to temporarily store the blocks of digital samples it receives from a analog-to-digital converter (AD);

a first computing circuit (RX) of an autocorrelation coefficient vector $C_x(i)$ of the digital samples for each block of said samples it receives from said first register (BF1);

a first read-only memory (VOCC) containing H autocorrelation coefficient vectors $C_a(i,h)$ of said quantized filter coefficients $a_h(i)$, where $1 \leqq h \leqq H$;

a second computing circuit (MINC) determining a spectral distance function $d_{LR}$ for each vector of coefficients $C_x(i)$ it receives from the first computing circuit (RX) and for each vector of coefficients $C_a(i,h)$ it receives from said first memory (VOCC), and determining the minimum of the H values of $d_{LR}$ obtained for each vector of coefficients $C_x(i)$ and supplying the corresponding index $H_{ott}$ on the output (9);

a second read-only-memory (VOCA), containing said codebook of vectors of quantized filter coefficients $a_h(i)$ and addressed by said indices $h_{ott}$;

a first linear-prediction inverse digital filter (LPCF) which receives said blocks of samples from the first register (BF1) and the vectors of coefficients $a_h(i)$ from said second memory (VOCA), and generates said residual signal R(j);

a second linear-prediction digital filter (FTW1) executing said frequency weighting of said residual signal R(j), thus obtaining said filtered residual signal S(j) supplied to a second register (BF2) which stores it temporarily and supplies said filtered residual vectors S(k) on a first output (15) and afterwards on a second output (16);

a circuit (ZCR) computing zero crossing frequency of each vector S(k) it receives from the first output (15) of said second register (BF2);

a computing circuit (VEF) of r.m.s. value of vector S(k) it receives from the first output (15) of the second register (BF2);

a first comparison circuit (CFR) for comparing the outputs of said computing circuits of zero crossing frequency (ZCR) and of r.m.s. value (VEF) with end values of pairs of intervals into which said plane (ZCR, $\sigma$) is subdivided, said values being stored in internal memories, the pair of intervals within which the pair of inputs values falls being associated with an index q supplied at the output;

a third read-only-memory (VOCS), sequentially addressed and containing said codebook of quantized r.m.s. values $\sigma_m$;

a first quantization circuit (CFM1) of the output of the r.m.s. computing circuit (VEF), by comparison with the output values of the third memory (VOCS), the quantization circuit emitting said quantized r.m.s. value $\sigma_m$ and the relevant index m on the first (22) and second (23) output;

a divider (DIV) dividing the second output (16) of the second register (BF2) by the second output (22) of the first quantization circuit (CFM1), and emitting said first vector S'(k);

a third register (BF3) which temporarily memorizes said first vector S'(k) and emits it on a first output (24) subdivided into Y vectors S'(y), and afterwards on a second output (25);

a computing circuit (MED) of the mean value of the components of each vector S'(y) it receives from the first output (24) of the third register (BF3), obtaining said vector of mean values S'(x) for each first vector S'(k);

a fourth read-only-memory (VOCM) containing Q codebooks of P vectors of quantized mean values Sp'(x), said memory being addressed by said index it receives from the first comparison circuit (CFR) to identify a codebook, and being sequentially addressed in the chosen codebook;

a second quantization circuit (CFM2) of the vector supplied by the computing circuit of the mean values (MED), by comparison with the vectors supplied by said fourth memory (VOCM), the circuit emitting said quantized mean value Sp'(x) and the relevant index on a first (29) and a second (30) output;

a first subtractor (SM1) of the vector of the first output (29) of the second quantization circuit (CFM2) from the vector of the second output (25) of the third register (BF3), the subtractor emitting said second normalized filtered residual vector S''(k);

a fifth read-only-memory (VOCR) which contains $Q \leqq P$ codebooks of N second quantized normalized filtered residual vectors Sn''(k), and is addressed by said indices it receives from said first and second comparison circuit (CFM1), CFM2), to identify a codebook and is addressed sequentially in the chosen codebook;

a second subtractor (SM2) which, for each vector received from said first substractor (SM1), computes the difference with all the vectors received by said fifth memory (VOCR) and obtains N quantization error vectors $E_n(k)$;

a computing circuit (MSE) of mean square error $m_{sen}$ relevant to each vector $E_n(k)$ received from said second substractor (SM2);

a comparison circuit (MIN) identifying, for each filtered residual vector S(k), the minimum mean square error of the relevant vectors $E_n(k)$ received from said computing circuit (MSE), and supplying the corresponding index $n_{min}$;

a fourth register (BF4) which emits on the output (38) said coded speech signal composed, for each block of samples x(j), of said index $h_{ott}$ supplied by said first read-only-memory, and of indices q, p, m, $n_{min}$ relevant to each filtered residual vector S(k).

4. A device according to claim 3, characterized in that for speech signal decoding it basically comprises:

a fifth register (BF5) which temporarily stores the coded speech signal it receives at the input (40), and supplies as reading addresses said index $h_{ott}$ to the second memory (VOCA), said index m to the third memory (VOCS), said indices q, p to the fourth memory (VOCM), said indices $n_{min}$ to the fifth memory (VOCR);

an adder (SM3) of the output vectors of the fifth (VOCR) and fourth (VOCM) memories;

a multiplier (MLT) of the output vector of said adder (SM3) by the output of said third memory (VOCS);

a third linear-prediction digital filter (FTW2), having an inverse transfer function of the one of said second digital filter (FTW1) and filtering the vectors received from said multiplier (MLT);

a fourth linear-prediction speech-synthesis digital filter (LPC) for the vectors it receives from said third digital filter (FTW2), which fourth filter supplies said digital-to-analog converter (AD) with said quantized digital samples (j), said third and fourth digital filters (FTW2, LPC) using coefficient vectors $a_h(i)$ received from said second memory (VOCA).

5. A device according to claim 3, characterized in that said second or third digital filters (FTW1, FTW2) computes its coefficient vectors $\lambda^i \cdot a_h(i)$ multiplying by constant values $\lambda^i$ the vectors of coefficients $a_h(i)$ they receive from said second memory (VOCA).

6. A device according to claim 3, characterized in that said second or third digital filter (FTW1, FTW2) receive the relevant vectors of coefficients $\lambda^i \cdot a_h(i)$ from a fifth read-only-memory addressed by said indices $h_{ott}$.

* * * * *